US008217891B2

(12) United States Patent
Wang et al.

(10) Patent No.: US 8,217,891 B2
(45) Date of Patent: Jul. 10, 2012

(54) DIELECTROPHORETIC DISPLAY

(75) Inventors: Tzu-Ming Wang, Hsinchu (TW); Kai-Cheng Chuang, Hsinchu (TW); Yi-Ching Wang, Hsinchu (TW)

(73) Assignee: E Ink Holdings Inc., Hsinchu County (TW)

( * ) Notice: Subject to any disclaimer, the term of this patent is extended or adjusted under 35 U.S.C. 154(b) by 546 days.

(21) Appl. No.: 12/421,995

(22) Filed: Apr. 10, 2009

(65) Prior Publication Data

US 2010/0207867 A1 Aug. 19, 2010

(30) Foreign Application Priority Data

Feb. 19, 2009 (TW) ..... 98105341 A

(51) Int. Cl.
*G09G 3/34* (2006.01)

(52) U.S. Cl. ..... 345/107; 359/296

(58) Field of Classification Search ..... 345/107, 345/204, 690; 359/296
See application file for complete search history.

(56) References Cited

U.S. PATENT DOCUMENTS

| | | | | |
|---|---|---|---|---|
| 5,961,804 | A | 10/1999 | Jacobson et al. | |
| 6,262,833 | B1 * | 7/2001 | Loxley et al. | 359/296 |
| 7,106,297 | B2 | 9/2006 | Shannon et al. | |
| 2001/0030639 | A1 * | 10/2001 | Goden | 345/107 |
| 2003/0070929 | A1 | 4/2003 | Shannon et al. | |
| 2007/0247418 | A1 | 10/2007 | Nakai et al. | |
| 2008/0252566 | A1 | 10/2008 | Kawase et al. | |
| 2009/0046051 | A1 * | 2/2009 | Choi et al. | 345/107 |

FOREIGN PATENT DOCUMENTS

| | | | |
|---|---|---|---|
| CN | 1914553 | A | 2/2007 |
| CN | 101331429 | A | 12/2008 |
| JP | 2-13228 | U | 1/1990 |
| JP | 2008-224839 | A | 9/2008 |
| KR | 20080067514 | A | 7/2008 |
| KR | 100862666 | B1 | 10/2008 |
| TW | 200938928 | A | 5/2012 |

OTHER PUBLICATIONS

Office Action from China Patent Office (dated Nov. 23, 2011).
Office Action from Japan Patent Office, Jan. 4, 2012.
Taiwan Official Action Issued on Apr. 26, 2012.
Korea Official Action issued on Mar. 8, 2012.

* cited by examiner

*Primary Examiner* — Stephen Sherman
(74) *Attorney, Agent, or Firm* — Chun-Ming Shih

(57) ABSTRACT

A display includes a first substrate, a partition element, a second substrate, a dielectric liquid, a plurality of dielectrophoretic particles and a plurality of electrophoretic particles. The partition element is disposed on the first substrate. The second substrate is disposed on the partition element. The partition element forms at least one accommodating room between the first substrate and the second substrate. The first substrate or the second substrate is adapted to forming an electric field in the accommodating room. The dielectric liquid is disposed in the accommodating room and has a first dielectric constant. The dielectrophoretic particles are dispersed in the dielectric liquid. Each of the dielectrophoretic particles has a first color and a second dielectric constant different from the first one. The electrophoretic particles are dispersed in the dielectric liquid. Each of the electrophoretic particles has a second color different from the first one. Another display is also provided.

3 Claims, 7 Drawing Sheets

DIELECTROPHORETIC DISPLAY

This application claims priority to a Taiwan application No. 098105341 filed on Feb. 19, 2009.

BACKGROUND

1. Field of the Invention

The present invention generally relates to a display, and more specifically, to a display applying the theory of dielectrophoresis.

2. Description of the Related Art

FIG. 1 is a schematic cross-sectional view of a conventional display. Referring to FIG. 1, the conventional display 100 includes a first substrate 110, a partition element 120, a second substrate 130, a dielectric liquid 140 and a plurality of dielectrophoretic particles 150. The first substrate 110 includes a first base 112 and a first electrode layer 114. The first electrode layer 114 is disposed on the first base 112 and has a plurality of white first electrode 114*a*. The partition element 120 is disposed on the first substrate 110.

The second substrate 130 is disposed on the partition element 120. The partition element 120 forms a plurality of accommodating rooms S1 between the first substrate 110 and the second substrate 130. Each of the accommodating rooms S1 can be regarded as a pixel unit. The second substrate 130 includes a second base 132 and a second electrode layer 134, and the second electrode layer 134 is disposed on the second base 132.

The dielectric liquid 140 is disposed in the accommodating rooms S1. The dielectric liquid 140 which is transparent has a first dielectric constant. The dielectrophoretic particles 150 are dispersed in the dielectric liquid 140. The dielectrophoretic particles 150 are black and each of the dielectrophoretic particles 150 has a second dielectric constant which is smaller than the first dielectric constant.

FIG. 2A is a schematic cross-sectional view of one of pixel units of the display of FIG. 1 which is in a first operation state. FIG. 2B is a schematic cross-sectional view of one of the pixel units of the display of FIG. 1 which is in a second operation state. Referring to FIG. 2A, as for the accommodating room S1, i.e. the pixel unit, when the pixel unit is in the first operation state, the first substrate 110 and the second substrate 130 form a non-uniform electric field E1 in the accommodating room S1, and the dielectrophoretic particles 150 move towards an area where the intensity of the electric field E1 is low. At this time, the dielectrophoretic particles 150 cover the first electrodes 114*a*, so that the pixel unit is black when a user sees the pixel unit from the viewing direction D1 shown in FIG. 2A.

Referring to FIG. 2B, as for the above accommodating room S1, when the pixel unit is in the second operation state, the first substrate 110 forms another non-uniform electric field E2 in the accommodating room S1 which is different from the electric field E1, and the dielectrophoretic particles 150 move towards an area where the intensity of the electric field E2 is low. At this time, the dielectrophoretic particles 150 don't cover the first electrodes 114*a*, so that the pixel unit is white when the user sees the pixel unit from the viewing direction D1 shown in FIG. 2B.

However, the conventional display 100 has the dielectrophoretic particles 150 which only show one color, and the display effect of the white first electrode 114*a* is more likely adversely affected by the dielectrophoretic particles 150 which are black when the pixel units of the display 100 are in the second operation state of FIG. 2B. Therefore, the display effect of the display 100 is bad.

BRIEF SUMMARY

The present invention is directed to provide a display of which the display effect is better.

The present invention provides a display including a first substrate, a partition element, a second substrate, a dielectric liquid, a plurality of dielectrophoretic particles and a plurality of electrophoretic particles. The partition element is disposed on the first substrate. The second substrate is disposed on the partition element. The partition element forms at least one accommodating room between the first substrate and the second substrate. The first substrate or the second substrate is adapted to forming an electric field in the accommodating room. The dielectric liquid is disposed in the accommodating room and has a first dielectric constant. The dielectrophoretic particles are dispersed in the dielectric liquid. Each of the dielectrophoretic particles has a first color and a second dielectric constant different from the first dielectric constant. The electrophoretic particles are dispersed in the dielectric liquid. Each of the electrophoretic particles has a second color different from the first color.

In one embodiment of the present invention, the first substrate has a first base and a first electrode layer. The first electrode layer is disposed on the first base and has at least one first electrode. The second substrate has a second base and a second electrode layer and the second electrode layer is disposed on the second base.

The present invention provides another display including a first substrate, a partition element, a second substrate, a dielectric liquid, a plurality of first dielectrophoretic particles and a plurality of second dielectrophoretic particles. The partition element is disposed on the first substrate. The second substrate is disposed on the partition element. The partition element forms at least one accommodating room between the first substrate and the second substrate. The first substrate or the second substrate is adapted to forming an electric field in the accommodating room. The dielectric liquid is disposed in the accommodating room and has a first dielectric constant. The first dielectrophoretic particles are dispersed in the dielectric liquid. Each of the first dielectrophoretic particles has a first color and a second dielectric constant larger than the first dielectric constant. The second dielectrophoretic particles are dispersed in the dielectric liquid. Each of the second dielectrophoretic particles has a second color and a third dielectric constant. The second color is different from the first color, and the third dielectric constant is smaller than the first dielectric constant. The shape of each of the second dielectrophoretic particles is different from that of each of the first dielectrophoretic particles.

In one embodiment of the present invention, the first substrate has a first base and a first electrode layer. The first electrode layer is disposed on the first base and has at least one first electrode. The second substrate has a second base and a second electrode layer and the second electrode layer is disposed on the second base.

In one embodiment of the present invention, one of each of the first dielectrophoretic particles and each of the second dielectrophoretic particles is stick-shaped, and the other of each of the first dielectrophoretic particles and each of the second dielectrophoretic particles is ball-shaped.

The display of the embodiment of the present invention has two kinds of particles having different colors, and each of the accommodating rooms which can be regarded as one pixel unit clearly displays two specific colors in the first and second operation states, respectively. Therefore, compared with the conventional technology, the display effect of the display of the embodiment of the present invention is better.

BRIEF DESCRIPTION OF THE DRAWINGS

The accompanying drawings are included to provide a further understanding of the invention, and are incorporated in and constitute part of this specification. The drawings illustrate embodiments of the invention and, together with the description, serve to explain the principles of the invention.

DETAILED DESCRIPTION

Reference will now be made to the drawings to describe exemplary embodiments of the present display method, in detail. The following description is given by way of example, and not limitation.

First Embodiment

Figure 1:
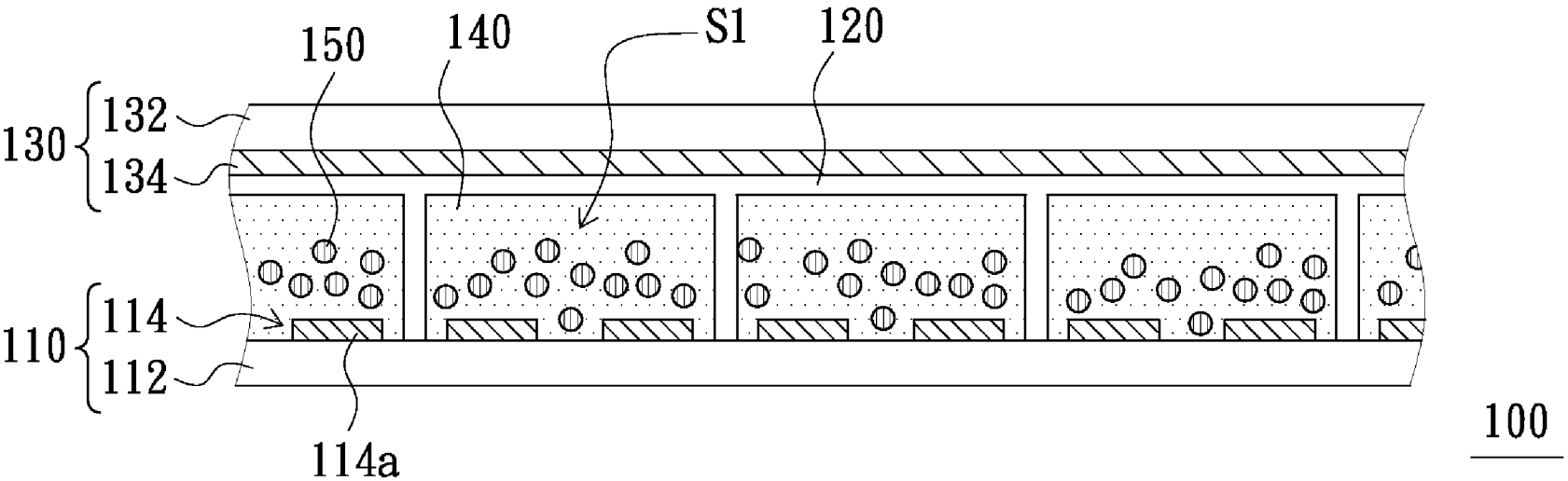
FIG. 1 (Prior Art)
FIG. 1 is a schematic cross-sectional view of a conventional display.
Figure 2B:
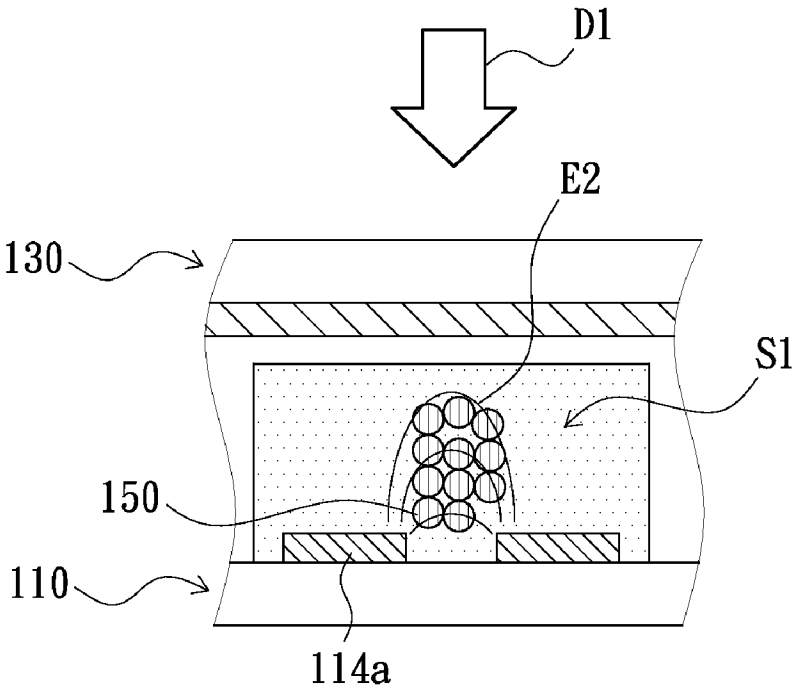
FIG. 2B (Prior Art)
FIG. 2B is a schematic cross-sectional view of one of the pixel units of the display of FIG. 1 which is in a second operation state.
Figure 2A:
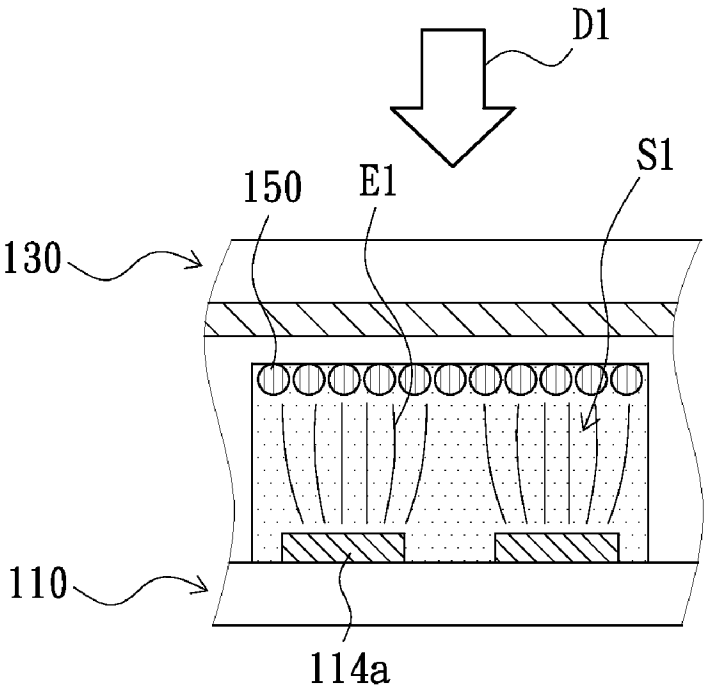
FIG. 2A (Prior Art)
FIG. 2A is a schematic cross-sectional view of one of pixel units of the display of FIG. 1 which is in a first operation state.
Figure 3:
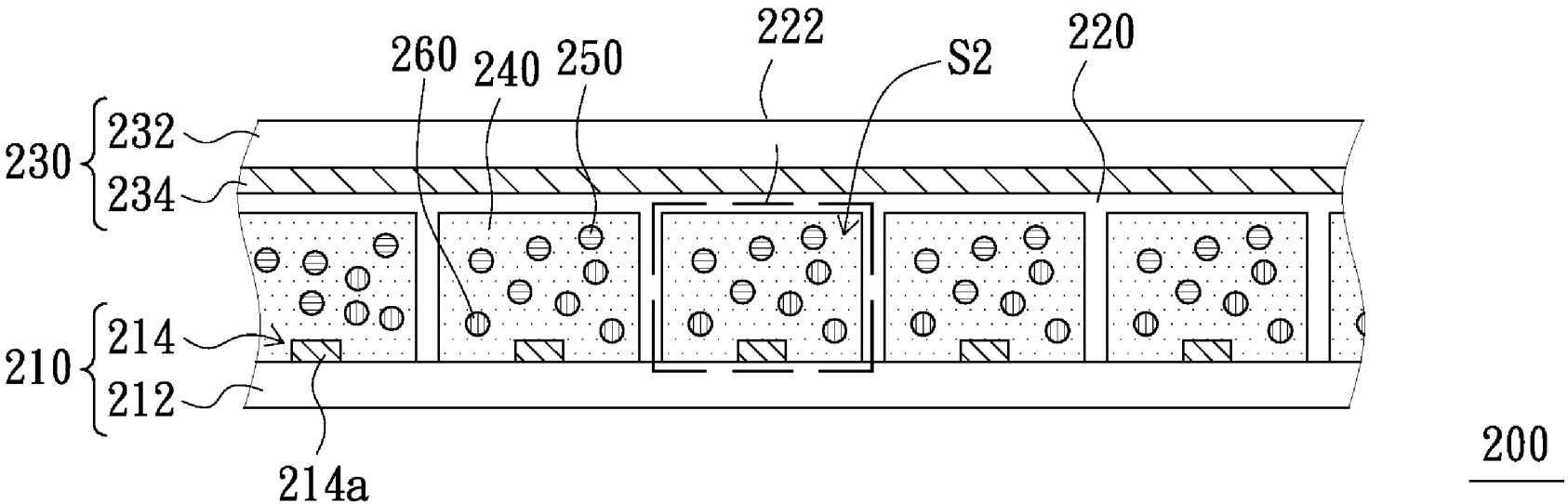
FIG. 3 is a schematic cross-sectional view of a display according to a first embodiment of the present invention.

FIG. 3 is a schematic cross-sectional view of a display according to a first embodiment of the present invention. Referring to FIG. 3, the display 200 of this embodiment has a first substrate 210, a partition element 220, a second substrate 230, a dielectric liquid 240, a plurality of dielectrophoretic particles 250 and a plurality of electrophoretic particles 260. The first substrate 210 has a first base 212 and a first electrode layer 214. The first electrode layer 214 is disposed on the first base 212 and has a plurality of first electrode 214*a*. The partition element 220 is disposed on the first substrate 210.

The second substrate 230 is disposed on the partition element 220. The partition element 220 forms a plurality of accommodating rooms S2 between the first substrate 210 and the second substrate 220. In this embodiment, the partition element 220 includes a plurality of microcups 222. Each of the accommodating rooms S2 can be regarded as a pixel unit and is located within the corresponding microcup 222. The second substrate 230 has a second base 232 and a second electrode layer 234, and the second electrode layer 234 is disposed on the second base 232. The first substrate 210 or the second substrate 230 is adapted to forming an electric field in the accommodating rooms S2. The above is described in detail in the following.

The dielectric liquid 240 is disposed in the accommodating rooms S2. The dielectric liquid 240 which is transparent has a first dielectric constant. The dielectrophoretic particles 250 are dispersed in the dielectric liquid 240. Each of the dielectrophoretic particles 250 has a first color and a second dielectric constant different from the first dielectric constant. In this embodiment, the second dielectric constant is smaller than the first dielectric constant. The electrophoretic particles 260 are dispersed in the dielectric liquid 240. Each of the electrophoretic particles 260 has a second color different from the first color. In this embodiment, each of the electrophoretic particles 260 is, for example, charged with positive electrical charges.

Figure 4B:
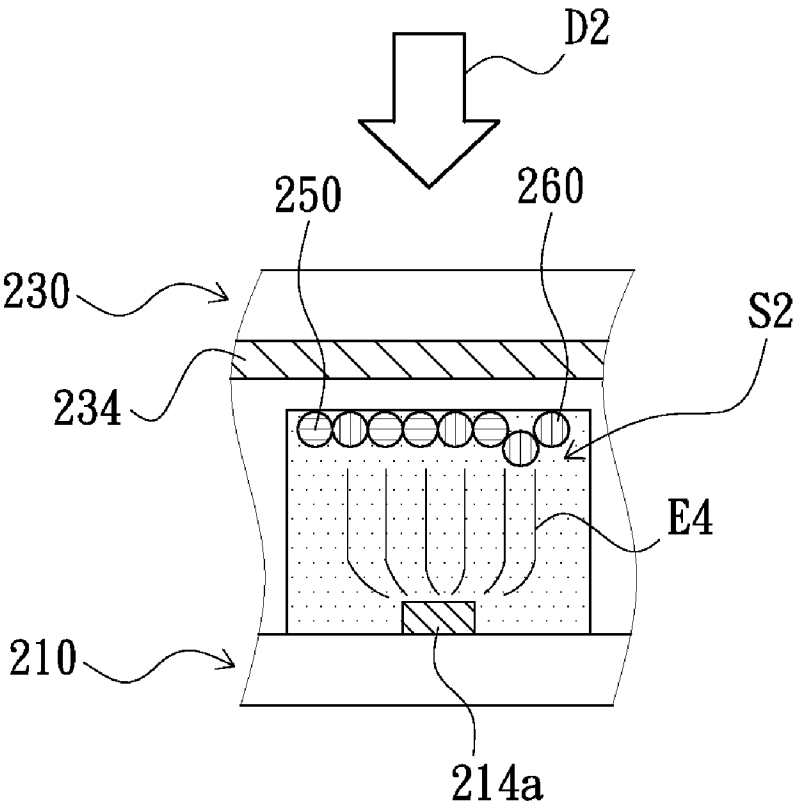
FIG. 4B is a schematic cross-sectional view of one of the pixel units of the display of FIG. 3 which is in a second operation state.
Figure 4A:
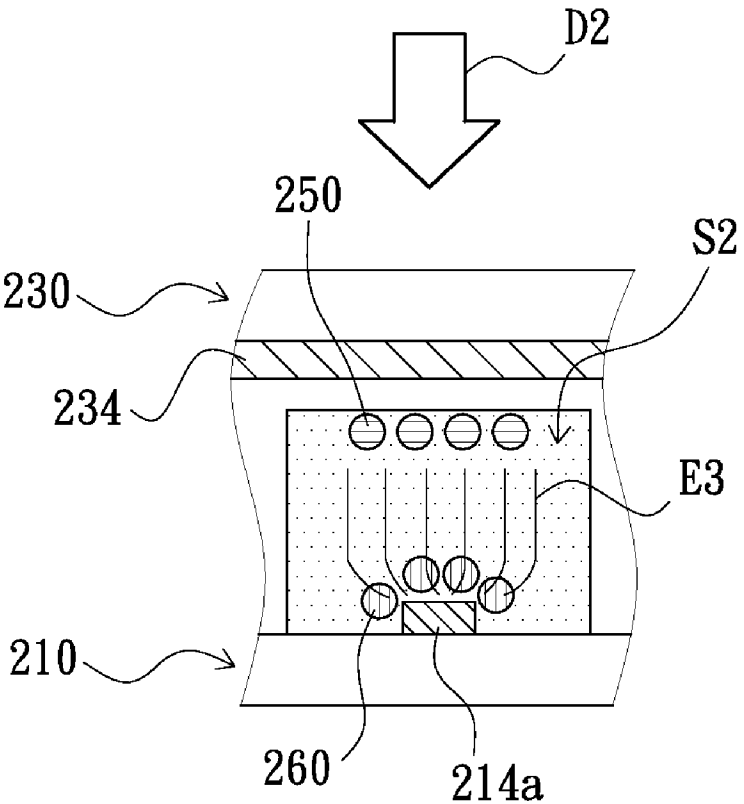
FIG. 4A is a schematic cross-sectional view of one of pixel units of the display of FIG. 3 which is in a first operation state.

FIG. 4A is a schematic cross-sectional view of one of pixel units of the display of FIG. 3 which is in a first operation state. FIG. 4B is a schematic cross-sectional view of one of the pixel units of the display of FIG. 3 which is in a second operation state. Referring to FIG. 4A, as for the accommodating room S2, i.e. the pixel unit, when the pixel unit is in the first operating state, the first substrate 210 and the second substrate 230 form a non-uniform electric field E3 in the accommodating room S3, and the voltage of the first electrode 214*a* is smaller than that of the second electrode layer 234. At this time, the dielectrophoretic particles 250 move towards an area where the intensity of the electric field E3 is low and which is near the second substrate 230, and the electrophoretic particles 260 move towards the first electrode 214*a*. As a result, the pixel unit shows the first color when a user sees the pixel unit in the viewing direction D2 shown in FIG. 4A.

Referring to FIG. 4B, as for the above accommodating room S2, when the pixel unit is in the second operation state, the first substrate 210 and the second substrate 230 form a no-uniform electric field E4 in the accommodating room S2 and the voltage of the first electrode 214*a* is larger than that of the second electrode layer 234. At this time, the dielectrophoretic particles 250 move towards an area where the intensity of the electric field E4 is low and which is near the second substrate 230, and the electrophoretic particles 260 move towards the second electrode layer 234. As a result, the pixel unit shows the hybrid color mixed with the first color and the second color when the user sees the pixel unit in the viewing direction D2 shown in FIG. 4B.

As mentioned above, the display 200 has two kinds of particles 250 and 260 having different colors, and each of the pixel units clearly displays the first color in the first operation state and the hybrid color mixed with the first color and the second color in the second operation state, respectively. Therefore, compared with the conventional technology, the display effect of the display 200 of the embodiment of the present invention is better.

Second Embodiment

Figure 5:
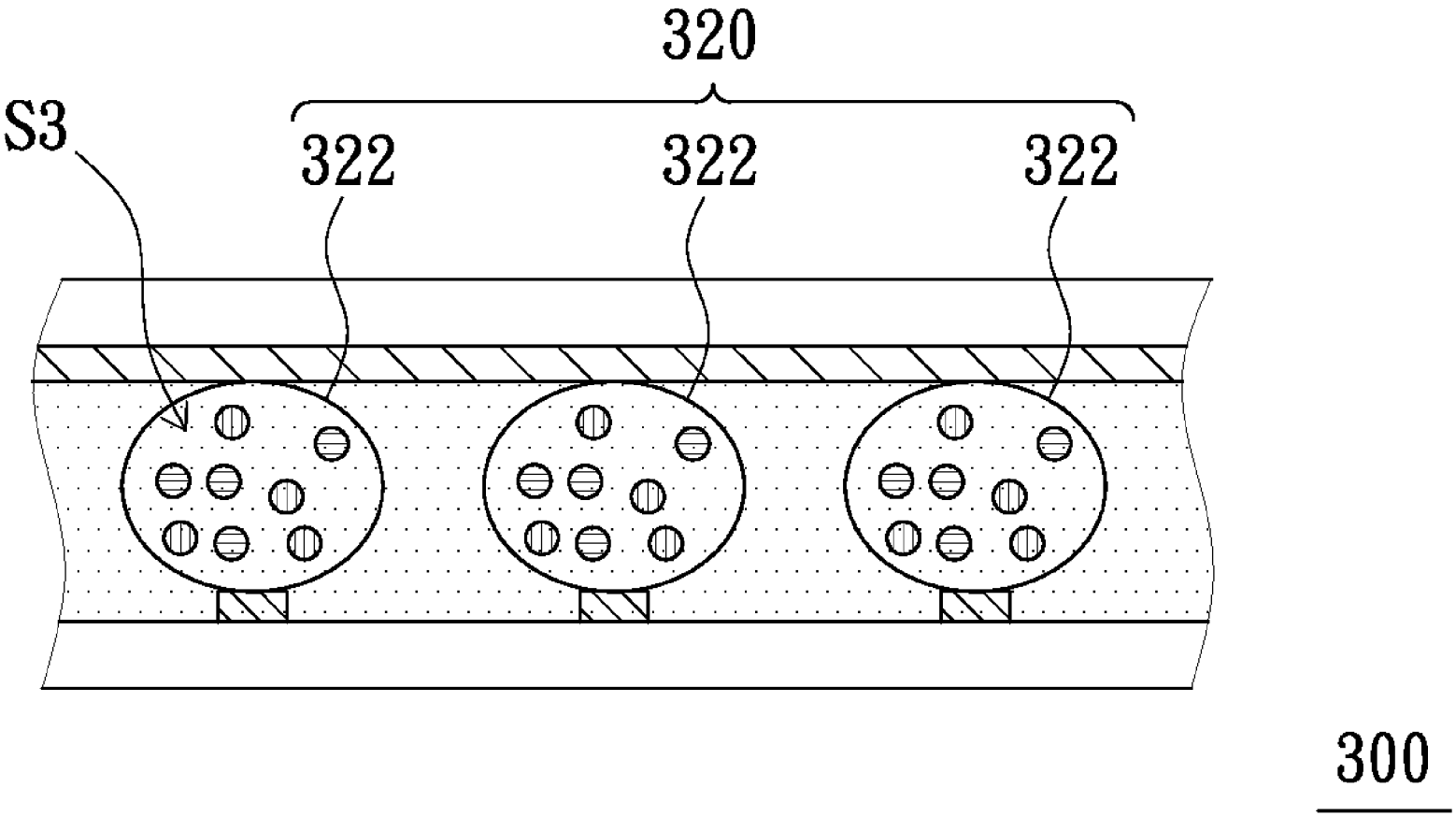
FIG. 5 is a schematic cross-sectional view of a display according to a second embodiment of the present invention.

FIG. 5 is a schematic cross-sectional view of a display according to a second embodiment of the present invention. Referring to FIG. 5, the difference between the display 300 of this embodiment and the display 200 of the first embodiment is that the partition element 320 of the display 300 includes a plurality of microcapsules 322. Each of the accommodating rooms S3 is located within the corresponding microcapsules 322.

Third Embodiment

Figure 6:
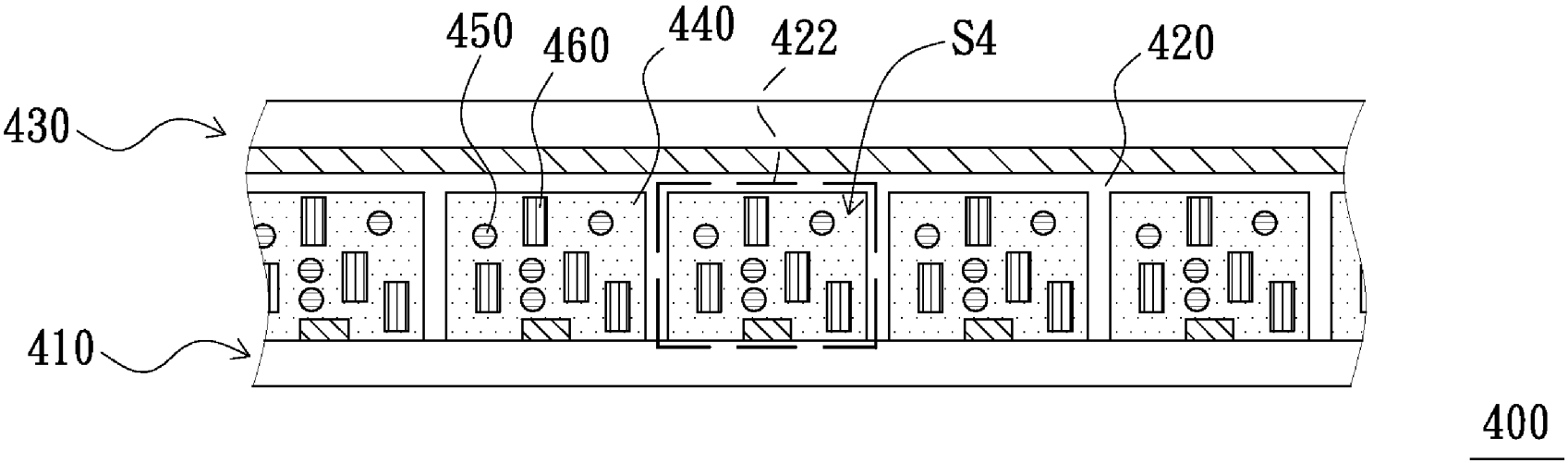
FIG. 6 is a schematic cross-sectional view of a display according to a third embodiment of the present invention.

FIG. 6 is a schematic cross-sectional view of a display according to a third embodiment of the present invention. Referring to FIG. 6, the difference between the display 400 of this embodiment and the display 200 of the first embodiment is that the display 400 includes a plurality of first dielectrophoretic particles 450 and a plurality of second dielectrophoretic particles 460. The dielectric liquid 400 is disposed in the accommodating rooms S4 and has a first dielectric constant. The first and second dielectrophoretic particles 450 and 460 are dispersed in the dielectric liquid 440.

Each of the first dielectrophoretic particles 450 has a first color and a second dielectric constant larger than the first dielectric constant. Each of the second dielectrophoretic particles 460 has a second color and a third dielectric constant. The second color is different from the first color, and the third dielectric constant is smaller than the first dielectric constant. The shape of each of the second dielectrophoretic particles 460 such as a shape of a stick is different from that of each of the first dielectrophoretic particles 450 such as a shape of a ball. In this embodiment, the second dielectrophoretic particles 460 which are stick-shaped are more easily polarized than the first dielectrophoretic particles 450 which are ball-shaped.

Figure 7B:
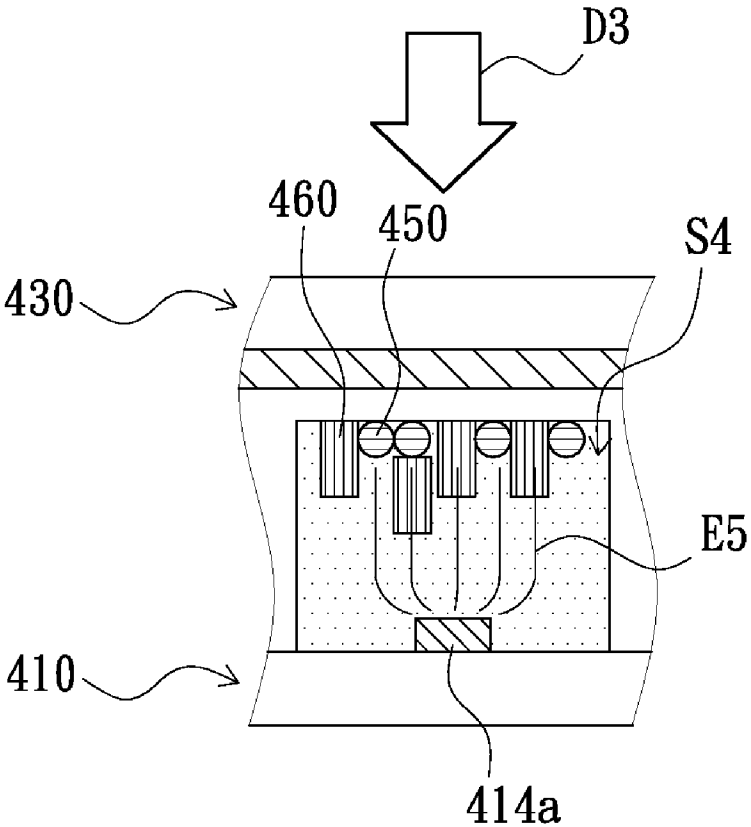
FIG. 7B is a schematic cross-sectional view of one of pixel units of the display of FIG. 6 which is in a second operation state.
Figure 7A:
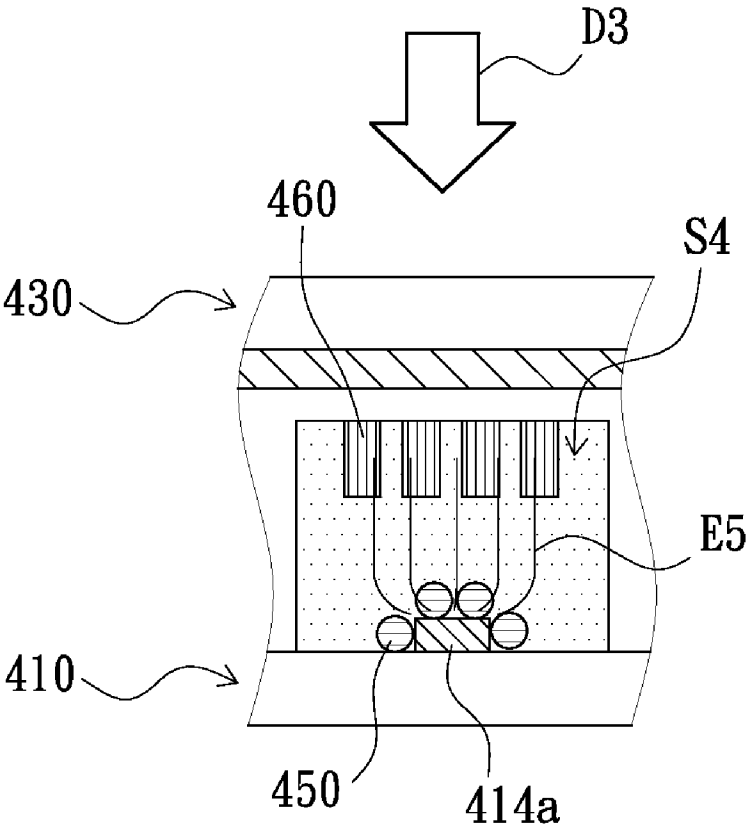
FIG. 7A is a schematic cross-sectional view of one of pixel units of the display of FIG. 6 which is in a first operation state.

FIG. 7A is a schematic cross-sectional view of one of pixel units of the display of FIG. 6 which is in a first operation state. FIG. 7B is a schematic cross-sectional view of one of pixel units of the display of FIG. 6 which is in a second operation state. Referring to FIG. 7A, as for the accommodating room S4, i.e. the pixel unit, when the pixel unit is in the first operation state, the first substrate 410 and the second substrate 430 form a non-uniform electric field E5 in the accommodating room S4, and the first driving frequency of the display 400 is low. At this time, the second dielectrophoretic particles 460 and the first dielectrophoretic particles 450 respond to the first driving frequency and are polarized. As result, the second dielectrophoretic particles 460 move towards an area where the intensity of the electric field E5 is low and which is near the second substrate 430, and the first dielectrophoretic particles 450 move towards an area where the intensity of the electric field E5 is high and which is near the first electrode 414*a* of the first substrate 410. As this time, the pixel unit shows the second color when the user sees the pixel unit in the viewing direction D3 shown in FIG. 7A.

Referring to FIG. 7B, as for the above accommodating room S4, when the pixel unit is in the second operation state, the first substrate 410 and the second substrate 430 form the non-uniform electric field E5 in the accommodating room S4, and the second driving frequency of the display 400 is higher than the first driving frequency. At this time, the second dielectrophoretic particles 460 respond to the second driving frequency and are polarized, and the first dielectrophoretic particles 450 can't respond to the second driving frequency. As result, the second dielectrophoretic particles 460 and the first dielectrophoretic particles 450 move towards the area where the intensity of the electric field E5 is low. As a result, the pixel unit shows hybrid colors mixed with the first color and the second color when the user sees the pixel unit in the viewing direction D3 shown in FIG. 7B.

Additionally, it should be noted that the microcups 422 of the partition element 420 (shown in FIG. 6) of this embodiment can be replaced by microcapsules (similar to that of the second embodiment) and not shown in figures.

As mentioned above, the displays of the embodiments of the present invention have at least one of the following advantages or other advantages. Each of the displays of the embodiments of the present invention has two kinds of particles having different colors, and each of the accommodating rooms which can be regarded as one pixel unit clearly displays two specific colors in the first and second operation states, respectively. Therefore, compared with the conventional technology, the display effect of each of the displays of the embodiments of the present invention is better.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A display comprising:

a first substrate comprising a first base and a first electrode layer, the first electrode layer being disposed on the first base and having at least one first electrode;

a partition element disposed on the first substrate;

a second substrate disposed on the partition element, the second substrate comprising a second base and a second electrode layer, the second electrode layer being disposed on the second base and the second electrode layer being a planar electrode, an area of the first electrode on the first base being smaller than an area of the second electrode on the second base, wherein the partition element forms at least one accommodating room between the first substrate and the second substrate, and the first electrode layer or the second electrode layer is adapted to forming a non-uniform electric field in the accommodating room;

a dielectric liquid disposed in the accommodating room and having a first dielectric constant;

a plurality of dielectrophoretic particles dispersed in the dielectric liquid, wherein each of the dielectrophoretic particles has a first color and a second dielectric constant different from the first dielectric constant; and a plurality of electrophoretic particles dispersed in the dielectric liquid, wherein each of the electrophoretic particles has a second color different from the first color;

wherein there are one electrode layer formed on the first substrate and one electrode layer formed on the second substrate, when the display is in a first operating state, the dielectrophoretic particles move towards the second electrode layer, and the electrophoretic particles move towards the first electrode layer, when the display is in a second operation state, the dielectrophoretic particles and the electrophoretic particles move towards the second electrode layer.

2. A display comprising:

a first substrate comprising a first base and a first electrode layer, the first electrode layer being disposed on the first base and having at least one first electrode;

a partition element disposed on the first substrate;

a second substrate disposed on the partition element, the second substrate comprising a second base and a second electrode layer, the second electrode layer being disposed on the second base and the second electrode layer being a planar electrode, an area of the first electrode on the first base being smaller than an area of the second electrode on the second base, wherein the partition element forms at least one accommodating room between the first substrate and the second substrate, and the first electrode layer or the second electrode layer is adapted to forming a non-uniform electric field in the accommodating room;

a dielectric liquid disposed in the accommodating room and having a first dielectric constant;

a plurality of first dielectrophoretic particles dispersed in the dielectric liquid, wherein each of the first dielectrophoretic particles has a first color and a second dielectric constant larger than the first dielectric constant; and a plurality of second dielectrophoretic particles dispersed in the dielectric liquid, wherein each of the second dielectrophoretic particles has a second color and a third dielectric constant, the second color is different from the first color, and the third dielectric constant is smaller than the first dielectric constant, the shape of each of the second dielectrophoretic particles is different from that of each of the first dielectrophoretic particles;

wherein there are one electrode layer formed on the first substrate and one electrode layer formed on the second substrate, when the display is in a first operating state, the second dielectrophoretic particles move towards the second electrode layer, and the first dielectrophoretic particles move towards the first electrode layer, when the display is in a second operation state, the first dielectrophoretic particles and the second dielectrophoretic particles move towards the second electrode layer.

3. The display as claimed in claim 2, wherein one of each of the first dielectrophoretic particles and each of the second dielectrophoretic particles is stick-shaped, and the other of each of the first dielectrophoretic particles and each of the second dielectrophoretic particles is ball-shaped.

* * * * *

UNITED STATES PATENT AND TRADEMARK OFFICE

CERTIFICATE OF CORRECTION

PATENT NO. : 8,217,891 B2
APPLICATION NO. : 12/421995
DATED : July 10, 2012
INVENTOR(S) : Tzu-Ming Wang et al.

It is certified that error appears in the above-identified patent and that said Letters Patent is hereby corrected as shown below:

Title Page, item (54) DIELECTROPHORETIC DISPLAY should be

(54) DISPLAY

Signed and Sealed this
Twenty-fifth Day of September, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,217,891 B2
APPLICATION NO. : 12/421995
DATED : July 10, 2012
INVENTOR(S) : Tzu-Ming Wang et al.

It is certified that error appears in the above-identified patent and that said Letters Patent is hereby corrected as shown below:

Title Page, item (54) and at Column 1, line 1, Title: "DIELECTROPHORETIC DISPLAY"

should be

-- DISPLAY --

This certificate supersedes the Certificate of Correction issued September 25, 2012.

Signed and Sealed this
Thirtieth Day of October, 2012

David J. Kappos

David J. Kappos
*Director of the United States Patent and Trademark Office*